US011561043B2

(12) United States Patent
Butts

(10) Patent No.: US 11,561,043 B2
(45) Date of Patent: Jan. 24, 2023

(54) SYSTEM AND METHOD FOR SMALL SCALE LNG PRODUCTION

(71) Applicant: BCCK Holding Company, Midland, TX (US)

(72) Inventor: Rayburn C. Butts, Midland, TX (US)

(73) Assignee: BCCK Holding Company, Midland, TX (US)

( * ) Notice: Subject to any disclaimer, the term of this patent is extended or adjusted under 35 U.S.C. 154(b) by 666 days.

(21) Appl. No.: 16/420,547

(22) Filed: May 23, 2019

(65) Prior Publication Data

US 2020/0370823 A1 Nov. 26, 2020

(51) Int. Cl.
*F25J 3/02* (2006.01)

(52) U.S. Cl.
CPC ..... *F25J 3/0209* (2013.01); *F25J 3/0233* (2013.01); *F25J 3/0295* (2013.01); *F25J 2205/02* (2013.01); *F25J 2205/30* (2013.01); *F25J 2210/42* (2013.01); *F25J 2210/60* (2013.01); *F25J 2215/60* (2013.01); *F25J 2230/42* (2013.01); *F25J 2230/60* (2013.01); *F25J 2240/12* (2013.01); *F25J 2245/42* (2013.01); *F25J 2270/06* (2013.01)

(58) Field of Classification Search
CPC ..... F25J 1/0022; F25J 3/0209; F25J 3/0266; F25J 3/0233; F25J 3/0295; F25J 2205/02; F25J 2205/30; F25J 2210/42; F25J 2210/60; F25J 2215/60; F25J 2230/42; F25J 2230/60; F25J 2240/12; F25J 2245/42; F25J 2270/06
See application file for complete search history.

(56) References Cited

U.S. PATENT DOCUMENTS

| | | | |
|---|---|---|---|
| 5,141,544 | A | 8/1992 | Butts |
| 5,257,505 | A | 11/1993 | Butts |
| 5,375,422 | A | 12/1994 | Butts |
| 5,615,561 | A | 4/1997 | Houshmand et al. |
| 5,617,741 | A | 4/1997 | McNeil et al. |

(Continued)

OTHER PUBLICATIONS

Zahradnik Ray Conversion of Coal Mine Methane to LNG for Heavy Vehicle Fuel, Appalachian-Pacific Coal Mine Methane Power Company, LLC (slides 1-30).

(Continued)

*Primary Examiner* — Brian M King
(74) *Attorney, Agent, or Firm* — Scheef & Stone, LLP; Robin L. Barnes

(57) ABSTRACT

A system and method for producing an LNG product stream to provide fuel to generators, as an alternative to diesel, to power drilling and other equipment. Using sales gas from a natural gas/NGL plant containing less than 95% methane as a feed stream, production of LNG having 95% or more methane in quantities of 100,000 GPD or more LNG product are achievable with the system and method. The system and method preferably combine use of strategic heat exchange between the feed and a nitrogen-methane flash vapor stream and other streams within the LNG processing system without requiring heat exchange with process streams in the natural gas/NGL plant and a rectifier column that uses an internal knockback condenser and does not require a reboiler to remove heavier components from the sales gas feed.

40 Claims, 2 Drawing Sheets

(56) References Cited

U.S. PATENT DOCUMENTS

| | | | | |
|---|---|---|---|---|
| 5,802,871 | A | 9/1998 | Howard et al. | |
| 5,916,260 | A * | 6/1999 | Dubar | F25J 3/0257 62/912 |
| 6,016,665 | A | 1/2000 | Cole et al. | |
| 6,070,429 | A | 6/2000 | Low et al. | |
| 6,401,486 | B1 * | 6/2002 | Lee | F25J 1/0216 62/630 |
| 6,526,777 | B1 | 3/2003 | Campbell et al. | |
| 8,584,488 | B2 | 11/2013 | Wilkinson et al. | |
| 9,016,088 | B2 | 4/2015 | Butts | |
| 9,612,050 | B2 | 4/2017 | Palmer | |
| 2006/0218968 | A1 * | 10/2006 | Mak | F25J 3/0242 62/625 |
| 2008/0271480 | A1 * | 11/2008 | Mak | F25J 1/0255 62/626 |
| 2011/0048067 | A1 * | 3/2011 | Fischer | F25J 1/0292 62/620 |
| 2013/0074542 | A1 * | 3/2013 | Mehrpooya | F25J 3/0209 62/621 |
| 2014/0013797 | A1 * | 1/2014 | Butts | H04W 24/02 62/621 |
| 2015/0204603 | A1 * | 7/2015 | Sheng | F25J 1/0052 62/614 |
| 2017/0167788 | A1 * | 6/2017 | Pierre, Jr. | F25J 3/0214 |
| 2017/0336137 | A1 * | 11/2017 | Mak | F25J 1/0228 |
| 2019/0120548 | A1 * | 4/2019 | Pierre, Jr. | F25J 1/0082 |
| 2019/0120550 | A1 * | 4/2019 | Mak | F25J 3/0209 |
| 2019/0186818 | A1 * | 6/2019 | Noureldin | F25J 1/0092 |
| 2020/0003490 | A1 * | 1/2020 | Valencia | B01D 3/166 |
| 2020/0056836 | A1 * | 2/2020 | Roberts | F25J 1/0072 |

OTHER PUBLICATIONS

Environmental Protection Agency, Coal Mine Methane and Lng, Epa Coalbed Methane Outreach Program Technical Options Series, Nov. 2008.

* cited by examiner

SYSTEM AND METHOD FOR SMALL SCALE LNG PRODUCTION

BACKGROUND OF THE INVENTION

1. Field of the Invention

This invention relates to a system and method for producing LNG from a processed sales gas stream by using efficient heat exchange and refrigeration cycles and separating out heavier hydrocarbons prior to liquefaction of the methane to produce LNG containing around 95% or more methane. The system and method are particularly suitable for field applications the processes sales gas stream contains less than 95% methane and where smaller quantities of LNG may be used for onsite power generation requirements using a natural gas turbine driven generator to provide power to drilling and fracturing equipment, to save on the costs and environmental concerns associated with diesel engines that typical provide power to such equipment.

2. Description of Related Art

Natural gas/NGL processing plants process natural gas to remove water, $H_2S$, $CO_2$ and to separate methane from Natural Gas Liquids (commonly referred to as NGLs, which typically comprises ethane, propane, butanes, pentanes, and other natural gasoline components) and nitrogen (which may be naturally occurring or may have been injected into the reservoir as part of an enhanced recovery operation) in order to meet pipeline requirements for sales gas. If desired, the processed sales gas or another stream from the natural gas/NGL plant, can be liquefied to produce an LNG product stream. There are several prior art methods to liquefy natural gas to produce an LNG product stream. These include using multiple flash vapor stages, utilizing streams from within the main natural gas/NGL plant for heat exchange, and cascade refrigeration using multiple single component refrigerant streams and multiple heat exchangers. The LNG product stream can then be transported offsite or used onsite to provide fuel to one or more generators to supply power to the processing plant and/or equipment used in drilling and fracturing operations. To use LNG as fuel in a turbine generator, it is preferable that the LNG contain around 95% or more methane. However, the sales gas (or residue) stream from many natural gas/NGL plants may contain around 90%+/− methane, around 3-4% nitrogen, 5-7% ethane, and small amounts C3+ heavier hydrocarbons, which cannot be liquefied according to these prior art methods to obtain an LNG product stream containing at least 95% methane.

For example, U.S. Pat. No. 5,615,561 discloses liquefying natural gas using multiple flash stages combined with heat exchange with a demethanizer column overhead stream in the natural gas/cryogenic NGL plant. The LNG feed stream in the '561 patent is a portion of a residue stream (or sales gas stream, which is the demethanizer overhead stream, downstream of heat exchange and compression). The LNG feed stream is liquefied by heat exchange with the demethanizer overhead stream (upstream of compression, at a temperature of around −160 F) and flash vapor streams from two to three flash stages. The optimal number of flash stages in the '561 patent is three (two expansion valve/flash drums and one expansion valve/storage tank), which increases capital costs for the system. Additionally, the '561 patent relies on heat exchange with the demethanizer overhead stream in the main NGL plant to liquefy the sales gas/LNG feed stream. That overhead stream must also provide sufficient cooling to the main plant inlet gas stream to achieve sufficient NGL separation. By tying the LNG heat exchange system to the NGL heat exchange system, the heat exchange system in the '561 patent is more complicated and can result in reduction of NGL recoveries and LNG production. The LNG produced using the system and method the '561 patent has a high methane purity; however, that purity level is achievable with the process of the '561 patent only by using a sales gas/LNG feed stream that is already at around 98% methane and 0.45% nitrogen. For plants where the sales gas/LNG feed stream contains less than 95% methane, which is common, it would not be possible to achieve 95%+ methane in the LNG product stream without additional separation of NGL components from the sales gas stream. The '561 patent is also only capable of producing around 10,000 GPD, which may be insufficient.

An example of cascade refrigeration is found in U.S. Pat. No. 6,016,665, which utilizes a propane refrigeration cycle and an ethylene refrigeration cycle and multiple heat exchangers to liquefy an LNG feed gas containing around 92-93% methane. The resulting LNG product in the '665 patent is only around 94.3% methane, which is less than desirable.

It is also know to use a separate LNG purification or fractionation column to further separate methane from heavier components when the LNG feed stream contains around 88-92% methane. For example, U.S. Pat. No. 6,526,777 discloses using an LNG purification tower incorporated into a cryogenic NGL plant to achieve a high purity LNG product stream. Rather than using a portion of the sales gas stream (which contains 98% methane) as the LNG feed, the '777 patent uses a portion of the main natural gas/NGL plant feed stream containing around 92% methane. That stream is cooled through heat exchange with an LNG purification tower overhead stream, a reboiler stream from the LNG purification tower, a portion of the NGL tower overhead stream (which becomes the residue/sales gas stream), and a flash vapor stream from the LNG storage tank, prior to feeding into the LNG purification tower. The overhead stream from the LNG purification tower is the LNG product stream (after further processing and heat exchange) and the bottoms stream is a feed stream into the NGL tower. Although fewer flash stages are used, the '777 patent still ties the LNG heat exchange system to the NGL heat exchange system, impacting the necessary cooling of the main plant inlet gas stream. The '777 patent also requires a second heat exchanger in the LNG system for additional (second stage) heat exchange between the LNG tower overhead stream and the flash vapor stream, resulting in additional capital costs. The process in the '777 patent is capable of producing a high purity LNG product having around 99% methane; however, the quantity of LNG product output compared to the LNG system feed is rather small. The LNG product stream in the '777 patent is only about 15% of the LNG feed amount on a lbmol/hr basis.

As another example, U.S. Pat. No. 8,584,488 also utilizes an LNG purification tower to produce an LNG product stream from an already processed (pipeline gas) feed stream. The system and method of the '488 patent are capable of producing LNG having 99%+ methane purity; however, there are numerous pieces of additional equipment needed, including four heat exchangers, two separators, and work expansion machines. Additionally, the LNG product stream in the '488 patent is only about 8.3% of the system feed amount on a lbmol/hr basis, with the remainder being returned to the pipeline as residue gas.

There is a need for a system and method that can be integrated with an existing natural gas/NGL processing plant or incorporated into a newly built natural gas/NGL processing plant that is capable of producing small, but substantial quantities (around 100,000 gallons per day or more) of LNG containing at least 95% methane that may be used as a generator fuel source to replace diesel engines , resulting in reduction of diesel engine emissions and savings on both operating and capital costs. There is also a need to produce such LNG from LNG system feed streams containing less than 95% methane, including such streams containing around 90%+/− methane. There is also a need for such a system and method that does not require heat exchange with process streams in the natural gas/NGL processing system, so that no processing changes need to be made to that system to be able to incorporate an LNG plant into an existing natural gas/NGL processing plant and there is no impact on NGL production or NGL plant feed stream cooling.

SUMMARY OF THE INVENTION

The system and method disclosed herein facilitate the economically efficient liquefaction of a portion of a sales gas stream from a natural gas/NGL processing plant to produce an LNG product containing 95% or more methane. According to one preferred embodiment, the portion of the sales gas stream is an LNG feed stream comprising less than 95% methane, more preferably around 88-93% methane, and 2-4% nitrogen, and heavier components, such as ethane and propane. If this stream were liquefied according to prior art methods, it would not be possible to produce a high purity LNG product stream having 95% or more methane because the heavier components would liquefy preferentially to the methane. Preferably, an LNG fractionation column of rectifier is used to separate out some of the heavier components prior to liquefying in order to obtain a higher purity methane overhead stream that can be liquefied to produce the LNG product stream.

According to another preferred embodiment, an LNG fractionation column or rectifier comprises an internal knockback condenser and does not require a reboiler. Preferably a liquid stream from a bottom of the column is expanded in an expansion valve to reduce the temperature and provide refrigerant to the condenser. Ethane and heavier components in a vapor stream at a top of the column are liquefied in the condenser and returned to the column, allowing a vapor overhead stream to exit the column containing more methane than the LNG feed stream.

According to another preferred embodiment, an LNG feed stream is cooled in a heat exchanger upstream of feeding into an LNG fractionation column or rectifier. Cooling is achieved through heat exchange with other streams within the LNG system, including a nitrogen-methane flash vapor stream and an expanded recycled refrigerant stream, without requiring any heat exchange between the sales gas/LNG feed stream and any process streams within the main natural gas/NGL plant process. According to another preferred embodiment, an LNG feed stream is split upstream of a heat exchanger so that only a portion passes through the heat exchanger and another portion bypasses the heat exchanger. Preferably these two streams are mixed together prior to feeding into an LNG fractionation column or rectifier. Splitting the LNG feed stream in this manner allows for the temperature of the remixed stream feeding into the fractionation tower to be controlled to achieve the desired liquid fraction.

According to another preferred embodiment, an overhead stream from an LNG fractionation column or rectifier is liquefied to produce an LNG product stream by cooling through heat exchange with other streams within the LNG system, including a nitrogen-methane flash vapor stream and an expanded recycled refrigerant stream, without requiring any heat exchange between the sales gas/LNG feed stream and any process streams within the main natural gas/NGL plant process. The LNG feed stream is also cooled through heat exchange with these same streams and is preferably the only stream from the main natural gas/NGL plant that is used in the heat exchange system within an LNG processing system and method according to a preferred embodiment of the invention. After cooling through heat exchange with other process streams, the overhead stream is preferably flashed in a single flash stage to produce an LNG product stream having 95% or more methane. Preferably, the single flash stage comprises an expansion valve through which the cooled overhead stream is expanded prior to entering into a storage tank or other vessel from which a nitrogen-methane flash vapor stream and an LNG product stream are discharged.

A system and method according to another preferred embodiment take advantage of a higher nitrogen content found in many sales gas streams to provide a flash vapor refrigerant stream. This nitrogen will be maintained in an overhead stream from a fractionation column or rectifier and will be liquefied with the methane in the overhead stream when cooled in a heat exchanger. The nitrogen will flash preferentially to the methane when expanded and stored in a low pressure storage tank or other flash stage vessel to produce a flash vapor stream, with the remaining liquid being discharged from the storage tank as the LNG product stream. This flash vapor stream is preferably used as a refrigerant stream for cooling an LNG feed stream and the overhead stream.

According to another preferred embodiment, a flash vapor stream preferably feeds into a refrigeration loop where it is preferably mixed with an expanded refrigeration stream to form a primary refrigerant stream, which is the stream used in a heat exchanger to cool an LNG feed stream and an overhead stream from an LNG fractionation tower or rectifier. After passing through the heat exchanger, the primary refrigerant stream is warmed to form a first recycle stream, which is then compressed through at least one and preferably two stages in compressor-expander units before being cooled in the heat exchanger to form a second recycle stream. The second recycle stream is then expanded through at least one and preferably two stages in the compressor expander units to form an expanded refrigerant stream that is sufficiently cooled to around the temperature of the flash vapor stream. The expanded refrigerant stream is then preferably mixed with the flash vapor stream to form the primary refrigerant stream and the loop is repeated. According to yet another preferred embodiment, the first recycle stream is compressed in an external compression stage upstream of compression in the compressor-expander unit(s). According to another preferred embodiment only a portion of the first recycle stream is cooled in the heat exchanger and another portion bypasses the heat exchanger. Preferably the two portions are remixed to form the second recycle stream upstream of being expanded. According to another preferred embodiment, a third portion of the first recycle stream is purged from the LNG processing system upstream of the heat exchanger. Preferably, the third portion is recycled to the natural gas/NGL plant for further processing.

According to another preferred embodiment, a bottoms stream from an LNG fractionation column or rectifier is also warmed in the heat exchanger before being purged from the LNG processing system. Preferably, the purged bottoms stream is recycled to the natural gas/NGL plant for further processing.

Systems and methods according to preferred embodiments of the invention allow for production of high purity LNG having 95% or more methane to be efficiently produced from a portion of a sales gas stream. Although the systems and methods may be used to produce an LNG product stream from an LNG feed stream containing 95% or more methane, preferred systems and methods are particularly suited sales gas/LNG feed streams comprising less than 95% methane. Preferred systems and methods of the invention are capable of producing up to or more than 100,000 GPD of LNG comprising 95% or more methane, which may be used to fuel natural gas turbine driven generators to provide electric drive power to drilling or fracturing equipment and/or other equipment that can consume natural gas as fuel. . The high purity LNG product stream may be used to replace diesel as a fuel source, providing an environmental benefit related to reducing or eliminating emissions from diesel consumption and a substantial operating expense cost savings as it would not be necessary to purchase diesel to run diesel engines or the amount of diesel, and associated emissions, can be significantly reduced. Systems according to preferred embodiments may easily be added on to an existing natural gas/NGL plant.

BRIEF DESCRIPTION OF THE DRAWINGS

The system and method of the invention are further described and explained in relation to the following drawings wherein.

DESCRIPTION OF THE PREFERRED EMBODIMENTS

Figure 1:
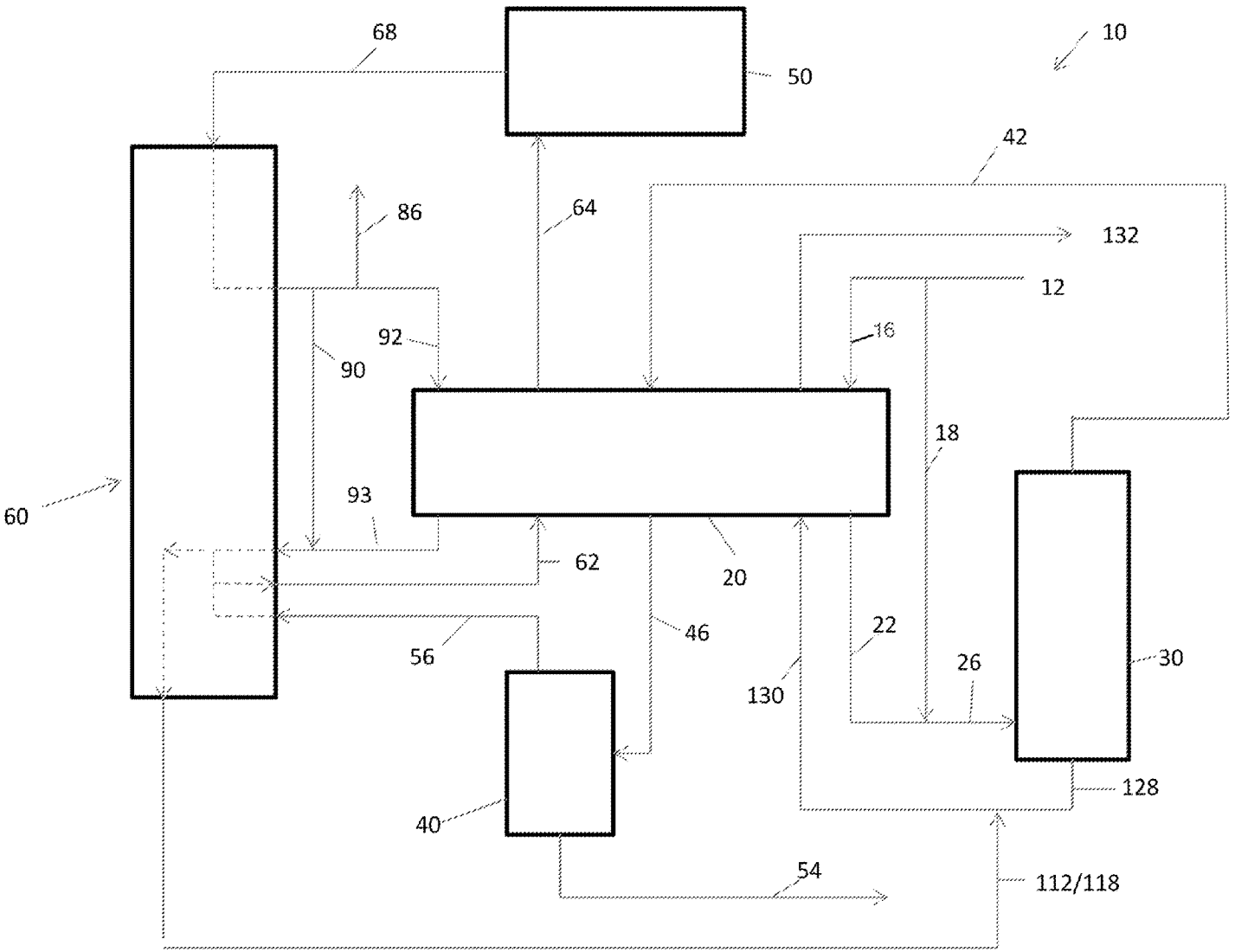
FIG. 1 is a simplified process flow diagram illustrating principal processing stages for producing an LNG product stream according to a preferred embodiment of the invention.

Referring to FIG. 1, a preferred embodiment of system 10 is depicted. System 10 preferably is located downstream of a natural gas/NGL processing plant to process a portion of a sales or residue gas stream into an LNG product stream. System 10 preferably comprises a heat exchanger 20, an LNG fractionation tower 30, an LNG storage tank 40, an external compression system 50, and a refrigeration loop 60. A portion of the sales or residue gas stream from primary plant is diverted to system 10 as feed stream 12. Feed stream 12 preferably comprises around 85-94.9% methane, more preferably around 90-95% methane, although system 10 may be used to process feed streams with 95% or more methane. Feed stream 12 is preferably split into streams 16 and 18. Stream 16 passes through heat exchanger 20 to be cooled, exiting as stream 22. Stream 18 bypasses heat exchanger 20 and is mixed with cooled stream 22 to form stream 26, which feeds into LNG fractionation column 30. By splitting feed stream 12 into streams 16 and 18, the temperature of stream 26 feeding into fractionation column 30 can be controlled as needed. The temperature of stream of 26 is controlled to preferably be between −85 and −95 F, depending on the inlet gas analysis, and more preferably between −88 and −94 F in order to provide a liquid fraction feeding into tower 30 that is preferably between 2.5 and 7.5_, more preferably between 4 and 6, depending on the composition feed stream 12.

LNG fractionation tower 30 is preferably a rectifier tower having an internal knockback condenser and no reboiler. The overhead stream 42 from tower 30 passes through heat exchanger 20, exiting as cooled LNG stream 46 that is then held in LNG storage tank 40. A flash vapor stream 56 from tank 40 enters refrigeration loop 60 and is mixed with an LP expander stream (another refrigerant stream within loop 60, not shown) to form stream 62, which is the primary refrigerant stream for cooling and liquefying LNG feed stream 12 and tower overhead stream 42. Refrigerant stream 62 passes through heat exchanger 20, exiting as stream 64, and is ultimately recycled back through heat exchanger 20 after passing through external compression stage 50 and being compressed in a portion of refrigeration loop 60. Refrigeration loop 60 preferably comprises two compressor/expander units. Stream 64 exits external compression stage 50 as stream 68, which passes through a first compressor and a second compressor of the two compressor/expander units in refrigeration loop 60 upstream of being recycled through heat exchanger 20. Stream 68 ultimately forms stream 92 downstream of compression. Stream 92 preferably has a pressure of around 900 psig as a result of the two compression stages and is cooled in heat exchanger 20 to form stream 93. Stream 93 then feeds into a first expander and a second expander of the two compressor/expander units to greatly reduce the temperature of this stream. Most preferably, stream 90 (portion of stream 68) bypasses heat exchanger 20 and is mixed with stream 93 prior to entering the two expanders. LP expander stream, which is preferably a mixed liquid/vapor stream, exits from the second expander and is mixed with flash vapor stream 56 to form stream 62 and the process of cycling stream 62 through heat exchanger 20, external compression stage 50, and refrigeration loop 60 is repeated. Most preferably, another portion of stream 68 downstream of compression is withdrawn from system 10 as an HP Purge stream 86. Stream 86 contains excess amounts of nitrogen and is preferably recycled back into the primary natural gas/NGL processing plant for further processing.

Refrigeration loop 60 may also comprise a separator and a scrubber. Preferably, the separator is upstream of the first expander and the scrubber is downstream of the first expander and upstream of the second expander. Stream 93 passes through the separator, with the overhead stream from the separator passing through the first expander and then feeding into the scrubber. The overhead stream from the scrubber then passes through the second expander to form LP expander stream that is mixed with flash stream 56. The bottoms streams from the separator and scrubber, streams 112 and 118, are preferably mixed with bottoms stream 128 from LNG fractionation tower 30 to form stream 130. Stream 130 then passes through heat exchanger 20, exiting as LP Purge steam 132 containing excess amounts of ethane and heavier components. LP Purge stream 132 is preferably recycled back into the primary natural gas/NGL processing plant for further processing.

LNG product stream 54 is withdrawn from tank 40 as needed to fuel turbines and other equipment at the drilling site or within the gas processing plant or for shipment to another end use application. LNG Product stream 54 preferably comprises at least 95% methane in liquid form, more preferably at least 97% methane in liquid form. System 10 is preferably capable of producing 100,000 gallons of high purity LNG per day or more. System 10 is also preferably capable of processing an LNG feed stream 12 in amount between 11 MMSCF to 13 MMSCFD and containing around 90%+/− methane into an LNG product stream containing at least 95% methane. System 10 is also preferably capable of producing an LNG product stream 254 with a flow rate that is preferably at least 95%, more preferably at least 97.5%, of the feed stream flow rate on a mass basis. System 10 is capable of producing such high purity LNG by cooling at least a portion of LNG feed stream 12 through heat exchange with a refrigeration loop stream comprising flash vapor from LNG storage tank 40 and a bottoms stream from the LNG rectifier tower. Refrigeration loop 60 is preferably a semi-open nitrogen/methane refrigerant loop utilizing a flash vapor stream preferably from a single flash vapor stage. Stream 46 entering LNG storage tank or flash stage vessel 40 preferably comprises around 2-3% nitrogen. The nitrogen flashes preferentially to the methane in LNG storage tank 40 when stored at low pressures in tank 40, which provides an ideal refrigerant to feed into refrigeration loop 60 and to cool at least a portion of feed stream 12. Flash vapor stream 56 preferably comprises around 30 to 50% nitrogen and around 50 to 70% methane. In prior art LNG processing methods, the amount of nitrogen in the LNG stream must be reduced to around 1% or less to avoid problems with storage. However, system 10 is specifically designed to increase the amount of nitrogen in the LNG stream to take advantage of the nitrogen in the LNG storage tank 40 preferentially flashing, which provides refrigerant to liquefy the rectification tower overhead stream 42 as it passes through heat exchanger 20. Additionally, since the LNG product stream 54 is preferably used as an on-site fuel source for generators, there is no need for extended storage of the LNG and the amount in nitrogen in LNG storage tank 40 is not detrimental.

Figure 2:
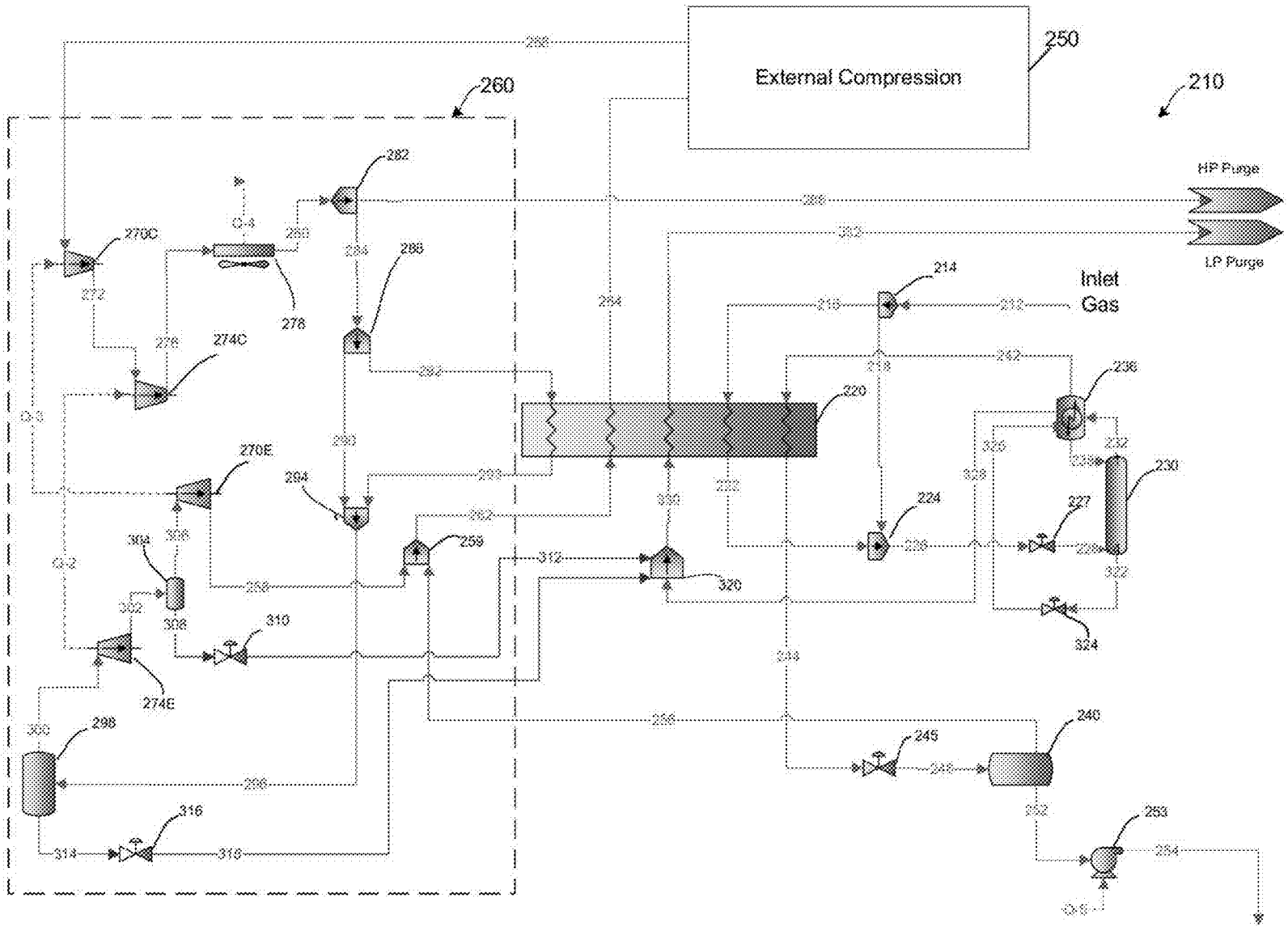
FIG. 2 is a more detailed process flow diagram illustrating principal processing stages for producing an LNG product stream according to a preferred embodiment of the invention.

Referring to FIG. 2, a preferred embodiment of system 210 is depicted. System 210 is similar to system 10 but includes more details regarding the various process flows and equipment that are preferably used according to one preferred embodiment of the invention. System 210 preferably is located downstream of a natural gas/NGL processing plant to process a portion of a sales or residue gas stream into an LNG product stream. System 210 preferably comprises a heat exchanger 220, an LNG fractionation tower 230, an LNG storage tank or flash stage vessel 240, an external compression system 250, and a refrigeration loop 260. System 210 will also be described herein in conjunction with a particular example for the compositions and parameters of the various streams based on a computer simulation. A portion of the sales or residue gas stream from the primary plant is diverted to system 210 as feed stream 212. For the particular example described herein, feed stream 212 has the following basic parameters: (1) Pressure of 700 PSIG; (2) Inlet temperature of 120° F.; (3) standard vapor volumetric flow of 12.5 Million Standard Cubic Feet per Day (MMSCFD); and (4) comprises around 89.1% methane and 3.4% nitrogen. The parameters of other streams described herein are exemplary based on the data for feed stream 212 used in a computer simulation. The temperatures, pressures, flow rates, and compositions of other process streams in system 210 will vary depending on the nature of the feed stream and other operational parameters, as will be understood by those of ordinary skill in the art.

Feed stream 212 is directed to splitter 214 where the inlet gas is strategically split into streams 216 and 218. Stream 216 passes through heat exchanger 220 to be cooled, exiting as stream 222 at a temperature of around −104 F. Stream 218 bypasses heat exchanger 220 and is mixed with cooled stream 222 in mixer 224 to form stream 226, which feeds into LNG fractionation column 230. By splitting feed stream 212 into streams 216 and 218, the temperature of stream 226 feeding into fractionation column 30 can be controlled as needed. The temperature of stream of 226 is controlled to preferably be between −75 and −95 F, more preferably between −80 and −90 Fin order to provide a liquid fraction feeding into tower 230 that is preferably between 2.5 and 7.5, more preferably between 4 and 6, depending on the composition feed stream 212. In this particular example, stream 216 comprises around 73% of the flow from stream 212 with the remainder in stream 218. Other split percentages may be used to achieve the desired feed temperature and liquid fraction for LNG tower feed stream 226 as will be understood by those of ordinary skill in the art. Most preferably, additional cooling of the LNG tower feed may be achieved by expanding stream 226 through expansion valve 227 to form stream 228 at a temperature of −104 F and a pressure of 210 psig with stream 228 feeding into a bottom of fractionation column 230.

LNG fractionation tower 230 is preferably a rectifier tower having an internal knockback condenser and no reboiler. Condenser 236 is depicted in FIG. 2 as two components (a tube side and a shell side) external to tower 230 for ease of showing the stream flows, but in practice this is preferably a knockback condenser that is internal to tower 230. Knockback condenser is preferably of the type disclosed in U.S. Patent Application Publication 2007/0180855, incorporated herein by reference. Stream 232 feeds into the tube side of condenser 236 with stream 238 returning to tower 230 and overhead stream 242 exiting.

The overhead stream 242 from tower 230 at around −124 F and 498 psig passes through heat exchanger 220, exiting as cooled LNG stream 244 at around −245 F. Stream 244 then passes through expansion valve 245 exiting as stream 246 having been slightly cooled to around −250 F and the pressure reduced to around 21 psig. Stream 246 feeds into LNG storage tank 240. Stream 246 comprises 3.97% nitrogen and 94% methane. The nitrogen in the LNG in storage tank 240 flashes preferentially to the methane when stored at low pressures (preferably around 25 to 0 psig). This allows a flash vapor stream 256 to be withdrawn from tank 240 and used as a refrigerant for cooling feed stream portion 216 in heat exchanger 220. Flash vapor stream 256, which comprises around 37% nitrogen and 63% methane, enters refrigeration loop 260 where it is preferably mixed with another refrigerant stream 258, further described below, to form refrigerant stream 262 at a temperature of around −250 F prior to passing through heat exchanger 220. Stream 262 exits heat exchanger 220 as stream 264 at a temperature of around 110 F. Stream 264 then enters external compression stage 250, where it is compressed to a pressure of around 400 psig before returning to refrigeration loop 260 as stream 268.

Stream 268 then enters a compressor portion of first compressor/expander unit 270C, exiting as stream 272 having a pressure of around 566 psig. Stream 272 then enters a compressor portion of a second compressor/expander unit 274C, exiting as stream 276 having a pressure of around 895 psig and a temperature around 284 F. It is then cooled in cooler 278, exiting as stream 280 having been cooled to around 120 F. Stream 280 is then preferably split in splitter 282 into stream 284 and a high pressure purge stream 286. High pressure purge stream 286 exits from refrigeration loop 260 and from system 210 and is preferably recycled back into the primary natural gas/NGL processing plant for further processing. The percentage of stream 280 that is split off into high pressure purge stream 286 will vary depending on operating parameters for system 210 and the composition of feed stream 212, but it is preferably between 0.5 and 1.5%. This purge stream 280 is equal in composition to the flash vapor 256 coming from the LNG Storage Tank number 240 Stream 284 is split again in splitter 288 into streams 290 and 292. Stream 292 passes through heat exchanger 220 exiting as stream 293 having been cooled to a temperature of around −87 F. Stream 290 bypasses heat exchanger 220 and is remixed with cooled stream 293 in mixer 294 to form stream 296. By having a portion of stream 284 bypass heat exchanger 220, the heat exchange may be controlled to provide sufficient cooling to the LNG feed stream 216 and the LNG tower overhead stream 242. In this example, around 36% of stream 284 bypasses heat exchanger 220 as stream 290. Depending on operating parameters for system 210 and the composition of feed stream 212, the amount of stream 284 that bypasses heat exchanger 220 will vary, but it is preferably between 25 and 50%.

Stream 296 then feeds into a separator 298, where it is separated into an overhead stream 300 and a bottoms stream 314. In this example, the entirety of stream 296 exits separator 298 as overhead stream 300. In some cases where the incoming feed stream 212 contains more than the desired amount of heavier than ethane components, there will be liquid condensed in the separator 298 and exiting the system via stream 314. Overhead stream 300 at a temperature of around −19.6 F and a pressure of around 890 psig then feeds into the expander portion of compressor/expander unit 274E. Stream 302 exits expander 274E having been cooled to around −173 F and a pressure of around 150 psig. Stream 302 then enters a low pressure scrubber 304 where it is separated into an overhead stream 306 and a bottoms stream 308. In this example, the entirety of stream 302 exits scrubber 304 as overhead stream 306. In some cases where there is excess ethane, it is expected that some liquid will be formed and separated in 304. In such case the liquid would be extracted and exit in stream 308.

Overhead stream 306 then feeds into the expander portion of compressor expander unit 270E, exiting as mixed liquid/vapor stream 258 having been cooled to around −250 F. Stream 258 is then mixed with flash vapor stream 256 in mixer 259 to form refrigerant stream 262. Refrigerant stream 262 is the primary cooling stream in heat exchanger 220 to cool feed stream portion 216 and LNG tower overhead stream 242.

In situations where a bottoms stream exits from separator 298 and/or scrubber 304, they are preferably mixed with a bottoms stream from LNG tower 230. Bottoms stream 314 is preferably passed through an expansion valve 316 to form stream 318. Bottoms stream 308 is preferably passed through an expansion valve 310 to form stream 312. Streams 318 and 312 are then mixed with stream 328 in mixer 320 to form stream 330. Stream 330 then passes through heat exchanger 220, exiting as LP Purge stream 332 having been warmed to around 111.5 F. LP Purge stream 332 contains around 68.8% methane, 26.5% ethane, and 3.1% propane and is preferably recycled back into the primary natural gas/NGL processing plant for further processing.

Liquid stream 322 from LNG Tower 230 bottom is expanded in valve 324 to reduce the temperature of exiting stream 326 to around −188 F and reduce the pressure to around 65 psig. Stream 326 provides refrigerant on the shell side of knockback condenser 236 to cool stream 232, which comprises around 93% methane, 3.6% nitrogen, and 3.5% ethane. Ethane and heavier components in stream 232 are liquefied and returned to LNG tower 230 as stream 238, comprising around 86.9% methane, 1.2% nitrogen, and 11.7% ethane. LNG tower overhead vapor stream 242 exits condenser 236 at a temperature of around −124 F and a pressure of around 498 psig and comprises around 94% methane, 3.97% nitrogen, and 2% ethane. Overhead stream 242 is then liquefied in heat exchanger 220, exiting as subcooled stream 244 with a temperature of around −245 F. As previously described, stream 244 is preferably expanded in valve 245 and stream 246 feeds into LNG storage tank 240.

LNG stream 252 is withdrawn from tank 240 as needed to fuel turbines and other equipment at the drilling site or and other application where natural gas fuel is desired. LNG stream 252 is preferably pumped using LNG loading pump 253 to produce LNG product stream 254 comprising around 95.1% methane, 2.8% nitrogen, and 2.1% ethane at a temperature of around −250 F and a pressure around 50 psig. Stream 254 has a flow rate of more than 120,000 gpd (1082.9 lbmol/hr) based on an LNG feed stream 212 flow rate of 12.5 MMSCFD (1372.47 lbmol/hr). System 210 is preferably capable of producing 100,000 gallons of high purity LNG per day or more. System 210 is also preferably capable of processing an inlet feed stream 212 in amount between 5 MMSCFD 15 MMSCD and containing around 90%+/− methane into an LNG product stream containing at least 95%

The flow rates, temperatures and pressures of various flow streams referred to in connection with the discussion of the system and method of the invention in relation to FIG. 2, are based on a computer simulation example for System 210 having an LNG feed gas stream 212 flow rate of 12.5 MMSCFD containing 3.39%% nitrogen, 89.4% methane, 6.49% ethane, 0.57% propane, and 0.09% isobutane, appear in Table 1 below. The values for energy streams referred to in connection with the discussions of the system and method of system 210 in relation to FIG. 2 appear in Table 2 below. The temperatures, pressures, flow rates, and compositions will vary depending on the nature of the feed stream and other operational parameters as will be understood by those of ordinary skill in the art.

TABLE 1

| Stream Composition | | | | |
|---|---|---|---|---|
| Mole Fraction | 212% | 216% | 218% | 222% |
| H2S | 0 * | 0 | 0 | 0 |
| CO2 | 0.0100015 * | 0.0100015 | 0.0100015 | 0.0100015 |
| N2 | 3.39543 * | 3.39543 | 3.39543 | 3.39543 |
| Helium | 0 * | 0 | 0 | 0 |
| C1 | 89.4031 * | 89.4031 | 89.4031 | 89.4031 |
| C2 | 6.49039 * | 6.49039 | 6.49039 | 6.49039 |
| C3 | 0.570914 * | 0.570914 | 0.570914 | 0.570914 |

TABLE 1-continued

| | | | | |
|---|---|---|---|---|
| iC4 | 0.0901442 * | 0.0901442 | 0.0901442 | 0.0901442 |
| nC4 | 0.0400641 * | 0.0400641 | 0.0400641 | 0.0400641 |

Stream Properties

| Property | Units | 212 | 216 | 218 | 222 |
|---|---|---|---|---|---|
| Temperature | ° F. | 120 * | 120 | 120 | −104.158 |
| Pressure | psig | 700 * | 700 | 700 | 699 |
| Molecular Weight | lb/lbmol | 17.5771 | 17.5771 | 17.5771 | 17.5771 |
| Mass Flow | lb/h | 24124.1 | 17701.3 | 6422.82 | 17701.3 |
| Liquid Volumetric Flow | gpm | 1377.54 | 1010.78 | 366.758 | 214.179 |
| Std Vapor Volumetric Flow | MMSCFD | 12.5 * | 9.17199 | 3.32801 | 9.17199 |

Stream Composition

| Mole Fraction | 226% | 228% | 232% | 238% | 242% |
|---|---|---|---|---|---|
| H2S | 0 | 0 | 0 | 0 | 0 |
| CO2 | 0.0100015 | 0.0100015 | 0.00934446 | 0.0199324 | 0.00739176 |
| N2 | 3.39543 | 3.39543 | 3.55967 | 1.31166 | 3.97427 |
| Helium | 0 | 0 | 0 | 0 | 0 |
| C1 | 89.4031 | 89.4031 | 92.9207 | 86.9749 | 94.0172 |
| C2 | 6.49039 | 6.49039 | 3.50547 | 11.6685 | 2 |
| C3 | 0.570914 | 0.570914 | 0.00482813 | 0.025009 | 0.00110624 |
| iC4 | 0.0901442 | 0.0901442 | 5.25016E−06 | 3.13982E−05 | 4.2777E−07 |
| nC4 | 0.0400641 | 0.0400641 | 1.07058E−06 | 6.478E−06 | 7.33126E−08 |

Stream Properties

| Property | Units | 226 | 228 | 232 | 238 | 242 |
|---|---|---|---|---|---|---|
| Temperature | ° F. | −86.6929 | −104.685 | −115.183 | −124.078 | −124.078 |
| Pressure | psig | 699 | 510 * | 498 | 498 | 498 |
| Molecular Weight | lb/lbmol | 17.5771 | 17.5771 | 16.9643 | 17.8488 | 16.8011 |
| Mass Flow | lb/h | 24124.1 | 24124.1 | 22520.3 | 3689.47 | 18830.9 |
| Liquid Volumetric Flow | gpm | 515.808 | 747.383 | 748.481 | 22.9948 | 585.117 |
| Std Vapor Volumetric Flow | MMSCFD | 12.5 | 12.5 | 12.0905 | 1.88261 | 10.2079 |

Stream Composition

| Mole Fraction | 244% | 246% | 252% | 254% | 256% |
|---|---|---|---|---|---|
| H2S | 0 | 0 | 0 | 0 | 0 |
| CO2 | 0.00739176 | 0.00739176 | 0.00764673 | 0.00764673 | 9.22208E−05 |
| N2 | 3.97427 | 3.97427 | 2.82491 | 2.82491 | 36.8785 |
| Helium | 0 | 0 | 0 | 0 | 0 |
| C1 | 94.0172 | 94.0172 | 95.0966 | 95.0966 | 63.1175 |
| C2 | 2 | 2 | 2.06972 | 2.06972 | 0.00388949 |
| C3 | 0.00110624 | 0.00110624 | 0.00114488 | 0.00114488 | 3.06424E−08 |
| iC4 | 4.2777E−07 | 4.2777E−07 | 4.42712E−07 | 4.42712E−07 | 2.78371E−13 |
| nC4 | 7.33126E−08 | 7.33126E−08 | 7.58734E−08 | 7.58734E−08 | 3.05175E−14 |

Stream Properties

| Property | Units | 244 | 246 | 252 | 254 | 256 |
|---|---|---|---|---|---|---|
| Temperature | ° F. | −245 * | −249.545 | −250.119 | −249.9 | −250.119 |
| Pressure | psig | 497 | 21 * | 20 | 50 * | 20 |
| Molecular Weight | lb/lbmol | 16.8011 | 16.8011 | 16.6734 | 16.6734 | 20.4577 |
| Mass Flow | lb/h | 18830.9 | 18830.9 | 18057 | 18057 | 773.892 |
| Liquid Volumetric Flow | gpm | 86.9068 | 356.764 | 83.7398 | 83.7348 | 304.453 |
| Std Vapor Volumetric Flow | MMSCFD | 10.2079 | 10.2079 | 9.86337 | 9.86337 | 0.34453 |

Stream Composition

| Mole Fraction | 258% | 262% | 264% | 268% | 272% |
|---|---|---|---|---|---|
| H2S | 0 | 0 | 0 | 0 | 0 |
| CO2 | 8.80718E−05 | 8.81091E−05 | 8.81091E−05 | 8.81091E−05 | 8.81091E−05 |
| N2 | 36.8634 | 36.8635 | 36.8635 | 36.8635 | 36.8635 |
| Helium | 0 | 0 | 0 | 0 | 0 |
| C1 | 63.1328 | 63.1326 | 63.1326 | 63.1326 | 63.1326 |
| C2 | 0.00380372 | 0.00380449 | 0.00380449 | 0.00380449 | 0.00380449 |
| C3 | 1.16771E−07 | 1.15995E−07 | 1.15995E−07 | 1.15995E−07 | 1.15995E−07 |
| iC4 | 8.08605E−12 | 8.01572E−12 | 8.01572E−12 | 8.01572E−12 | 8.01572E−12 |
| nC4 | 1.17932E−12 | 1.16897E−12 | 1.16897E−12 | 1.16897E−12 | 1.16897E−12 |

TABLE 1-continued

Stream Properties

| Property | Units | 258 | 262 | 264 | 268 | 272 |
|---|---|---|---|---|---|---|
| Temperature | ° F. | −250.936 | −250.933 | 110.599 | 120 | 187.195 |
| Pressure | psig | 20 * | 20 | 18 | 400 * | 566.262 |
| Molecular Weight | lb/lbmol | 20.4559 | 20.4559 | 20.4559 | 20.4559 | 20.4559 |
| Mass Flow | lb/h | 85137.5 | 85911.3 | 85911.3 | 85911.3 | 85911.3 |
| Liquid Volumetric Flow | gpm | 32508.9 | 32812.9 | 103160 | 7713.27 | 6188.88 |
| Std Vapor Volumetric Flow | MMSCFD | 37.9059 | 38.2504 | 38.2504 | 38.2504 | 38.2504 |

Stream Composition

| Mole Fraction | 276% | 280% | 284% | 286% | 290% |
|---|---|---|---|---|---|
| H2S | 0 | 0 | 0 | 0 | 0 |
| CO2 | 8.81091E−05 | 8.81091E−05 | 8.81091E−05 | 8.81091E−05 | 8.80718E−05 |
| N2 | 36.8635 | 36.8635 | 36.8635 | 36.8635 | 36.8634 |
| Helium | 0 | 0 | 0 | 0 | 0 |
| C1 | 63.1326 | 63.1326 | 63.1326 | 63.1326 | 63.1328 |
| C2 | 0.00380449 | 0.00380449 | 0.00380449 | 0.00380449 | 0.00380372 |
| C3 | 1.15995E−07 | 1.15995E−07 | 1.15995E−07 | 1.15995E−07 | 1.16771E−07 |
| iC4 | 8.01572E−12 | 8.01572E−12 | 8.01572E−12 | 8.01572E−12 | 8.08605E−12 |
| nC4 | 1.16897E−12 | 1.16897E−12 | 1.16897E−12 | 1.16897E−12 | 1.17932E−12 |

Stream Properties

| Property | Units | 276 | 280 | 284 | 286 | 290 |
|---|---|---|---|---|---|---|
| Temperature | ° F. | 284.337 | 120 * | 120 | 120 | 120 |
| Pressure | psig | 895.936 | 893.436 | 893.436 | 893.436 | 893.703 |
| Molecular Weight | lb/lbmol | 20.4559 | 20.4559 | 20.4559 | 20.4559 | 20.4559 |
| Mass Flow | lb/h | 85911.3 | 85911.3 | 85137.5 | 773.823 | 30900.2 |
| Liquid Volumetric Flow | gpm | 4605.54 | 3449.28 | 3418.21 | 31.0684 | 1240.25 |
| Std Vapor Volumetric Flow | MMSCFD | 38.2504 | 38.2504 | 37.9059 * | 0.34453 | 13.7577 |

Stream Composition

| Mole Fraction | 292% | 293% | 296% | 300% | 302% |
|---|---|---|---|---|---|
| H2S | 0 | 0 | 0 | 0 | 0 |
| CO2 | 8.80718E−05 | 8.80718E−05 | 8.80718E−05 | 8.80718E−05 | 8.80718E−05 |
| N2 | 36.8634 | 36.8634 | 36.8634 | 36.8634 | 36.8634 |
| Helium | 0 | 0 | 0 | 0 | 0 |
| C1 | 63.1328 | 63.1328 | 63.1328 | 63.1328 | 63.1328 |
| C2 | 0.00380372 | 0.00380372 | 0.00380372 | 0.00380372 | 0.00380372 |
| C3 | 1.16771E−07 | 1.16771E−07 | 1.16771E−07 | 1.16771E−07 | 1.16771E−07 |
| iC4 | 8.08605E−12 | 8.08605E−12 | 8.08605E−12 | 8.08605E−12 | 8.08605E−12 |
| nC4 | 1.17932E−12 | 1.17932E−12 | 1.17932E−12 | 1.17932E−12 | 1.17932E−12 |

Stream Properties

| Property | Units | 292 | 293 | 296 | 300 | 302 |
|---|---|---|---|---|---|---|
| Temperature | ° F. | 120 | −86.6929 * | −19.4661 | −19.6075 | −173.208 |
| Pressure | psig | 893.703 | 892.703 | 892.703 | 890.203 | 150 * |
| Molecular Weight | lb/lbmol | 20.4559 | 20.4559 | 20.4559 | 20.4559 | 20.4559 |
| Mass Flow | lb/h | 54237.3 | 54237.3 | 85137.5 | 85137.5 | 85137.5 |
| Liquid Volumetric Flow | gpm | 2176.93 | 1044.84 | 2307.11 | 2313.1 | 8616.48 |
| Std Vapor Volumetric Flow | MMSCFD | 24.1481 | 24.1481 | 37.9059 | 37.9059 | 37.9059 |

Stream Composition

| Mole Fraction | 306% | 308% | 312% | 314% | 318% |
|---|---|---|---|---|---|
| H2S | 0 | | | | |
| CO2 | 8.80718E−05 | | | | |
| N2 | 36.8634 | | | | |
| Helium | 0 | | | | |
| C1 | 63.1328 | | | | |
| C2 | 0.00380372 | | | | |
| C3 | 1.16771E−07 | | | | |
| iC4 | 8.08605E−12 | | | | |
| nC4 | 1.17932E−12 | | | | |

Stream Properties

| Property | Units | 306 | 308 | 312 | 314 | 318 |
|---|---|---|---|---|---|---|
| Temperature | ° F. | −173.573 | | | | |
| Pressure | psig | 147.5 | 147.5 | | 890.203 | 155 * |

TABLE 1-continued

| | | | | | | |
|---|---|---|---|---|---|---|
| Molecular Weight | lb/lbmol | 20.4559 | | | | |
| Mass Flow | lb/h | 85137.5 | 0 | 0 | 0 | 0 |
| Liquid Volumetric Flow | gpm | 8754.54 | | | | |
| Std Vapor Volumetric Flow | MMSCFD | 37.9059 | 0 | 0 | 0 | 0 |

Stream Composition

| Mole Fraction | 322% | 326% | 328% | 330% | 332% |
|---|---|---|---|---|---|
| H2S | 0 | 0 | 0 | 0 | 0 |
| CO2 | 0.0216241 | 0.0216241 | 0.0216241 | 0.0216241 | 0.0216241 |
| N2 | 0.817585 | 0.817585 | 0.817585 | 0.817585 | 0.817585 |
| Helium | 0 | 0 | 0 | 0 | 0 |
| C1 | 68.8537 | 68.8537 | 68.8537 | 68.8537 | 68.8537 |
| C2 | 26.4884 | 26.4884 | 26.4884 | 26.4884 | 26.4884 |
| C3 | 3.10856 | 3.10856 | 3.10856 | 3.10856 | 3.10856 |
| iC4 | 0.491602 | 0.491602 | 0.491602 | 0.491602 | 0.491602 |
| nC4 | 0.21849 | 0.21849 | 0.21849 | 0.21849 | 0.21849 |

Stream Properties

| Property | Units | 322 | 326 | 328 | 330 | 332 |
|---|---|---|---|---|---|---|
| Temperature | ° F. | −106.615 | −189.567 | −123.274 | −123.274 | 111.538 * |
| Pressure | psig | 500 | 62.5 | 60 * | 60 | 58 |
| Molecular Weight | lb/lbmol | 21.0327 | 21.0327 | 21.0327 | 21.0327 | 21.0327 |
| Mass Flow | lb/h | 5293.25 | 5293.25 | 5293.25 | 5293.25 | 5293.25 |
| Liquid Volumetric Flow | gpm | 27.6676 | 513.539 | 1208.96 | 1208.96 | 2668.42 |
| Std Vapor Volumetric Flow | MMSCFD | 2.2921 | 2.2921 | 2.2921 | 2.2921 | 2.2921 |

It will be appreciated by those of ordinary skill in the art that these values are based on the particular parameters and composition of the feed stream in the above example. The values will differ depending on the parameters and composition of the feed stream 212.

Another preferred system for producing LNG comprising at least 95% methane from a feed stream, such as feed stream 12 or 212 comprising less than 95% methane comprises: (1) a first fractionating column or rectifier wherein the feed stream is separated into a first overhead stream and a first bottoms stream, wherein the first fractionating column or rectifier preferably comprises an internal knockback condenser and does not require a reboiler; (2) a heat exchanger for cooling at least a first portion of the feed stream upstream of the first fractionating column, for cooling the first overhead stream, and for cooling at least a first portion of a compressed recycle stream through heat exchange with the first bottoms stream and a primary refrigerant stream; (3) a flash stage comprising a storage tank or flash stage vessel configured to receive the first overhead stream downstream of the heat exchanger, discharge a flash vapor stream, and discharge the LNG product stream; and (4) a refrigeration loop comprising at least one and preferably at two compressor expander units and a first mixer, wherein (a) the primary refrigerant stream is warmed in the heat exchanger to form a first recycle stream; (b) the first recycle stream is compressed in the first compressor expander unit, and preferably also compressed in the second compressor expander unit, to form the compressed recycle stream; (c) at least the first portion of the compressed recycle stream is cooled in the heat exchanger to form a second recycle stream; (d) the second recycle stream is expanded in the first compressor expander unit and expanded in the second compressor expander unit to form an expanded refrigerant stream; and (e) the expanded refrigerant stream is mixed with the flash vapor stream in the first mixer to form the primary refrigerant stream.

Other preferred systems comprise one or more of the following additional components: (5) a first splitter for splitting the feed stream into the first portion and a second portion, wherein the first portion is cooled in the heat exchanger and the second portion bypasses the heat exchanger; (6) a second mixer for mixing the first portion of the feed stream downstream of the heat exchanger with the second portion of the feed stream prior to feeding into the fractionating column; (7) an expansion valve to expand a liquid stream from a bottom of the fractionating column to reduce the temperature of the liquid stream prior to entering the condenser; (8) an expansion valve to expand the feed stream downstream of the second mixer and upstream of feeding the fractionation column; (9) an expansion valve, as part of a flash stage, for expanding the first overhead stream downstream of the heat exchanger and upstream of the storage tank or flash stage vessel; and (10) one or more compressors, preferably external to the LNG processing system, to compress the first recycle stream to a pressure of 350 to 400 psig upstream of the first compressor expander unit in the refrigeration loop. There is only a single flash stage and/or only a single heat exchanger (excluding a condenser in the LNG fractionation tower) in an LNG system according to the other preferred embodiments of the invention.

Other preferred embodiments of the refrigeration loop comprise one or more of the following components: (f) a separator configured to separate the second recycle stream into a second overhead stream and a second bottoms stream, wherein the second overhead stream is expanded in the compressor expander unit in step (d); (g) a scrubber configured to separate the expanded second overhead stream into a third overhead stream and a third bottoms stream, wherein the third overhead stream is expanded in a second compressor expander unit in step (d) to form the expanded refrigerant stream; (h) a mixer for mixing the first bottoms stream with the second and third bottoms streams prior to being warmed in the heat exchanger; (i) a cooler for cooling the compressed recycle stream upstream of the heat exchanger; (j) a first splitter to split the compressed recycle stream into a first portion and a second portion, wherein the first portion is cooled in the heat exchanger and the second portion bypasses the heat exchanger; and (k) a mixer for mixing the cooled first portion of the compressed recycle stream and the second portion of the compressed recycle stream downstream of the heat exchanger to form the second recycle stream.

A preferred method producing LNG comprising at least 95% methane from a feed stream, such as feed stream 12 or 212, comprising less than 95% methane comprises the following steps: (1) separating the feed stream in a first fractionating column or rectifier into a first overhead stream and a first bottoms stream, wherein the fractionating column or rectifier most preferably comprises an internal knockback condenser and does not require a reboiler; (2) cooling at least a first portion of the feed stream prior to the first fractionating column and cooling the first overhead stream through heat exchange with other process streams in a heat exchanger; (3) flash expanding the cooled first overhead stream to form a flash vapor stream and the LNG product stream; (4) warming a primary refrigerant stream in the heat exchanger to form a first recycle stream; (5) compressing the first recycle stream in at least one and preferably two successive compressor expander units to form a compressed recycle stream, preferably having a pressure of 750 to 900 psig; (6) cooling at least a first portion of the compressed recycle stream to form a second recycle stream; (7) expanding the second recycle stream in at least one and preferably two successive compressor expander units to form an expanded refrigerant stream, preferably having a pressure of 10 to 20 psig and a temperature of −260 to −235 F; and (8) mixing the expanded refrigerant stream and the flash vapor stream to form the primary refrigerant stream.

Other preferred methods comprise one or more of the following additional steps: (9) splitting the feed stream into a first portion and a second portion, wherein the first portion is cooled in the heat exchanger and the second portion bypasses the heat exchanger, and mixing the cooled first portion of the feed stream downstream of the heat exchanger with the second portion of the feed stream prior to feeding into the fractionating column; (10) separating the second recycle stream into a second overhead stream and a second bottoms stream in a separator, wherein the second overhead stream is expanded in a first compressor expander unit in step 7; (11) separating the expanded second overhead stream into a third overhead stream and a third bottoms stream in a scrubber, wherein the third overhead stream is expanded in a second compressor expander unit in step 7 to form the expanded refrigerant stream; (12) mixing the first bottoms stream with the second and third bottoms streams to form a mixed bottoms stream and warming the mixed bottoms stream in the heat exchanger; (13) recycling the warmed mixed bottoms stream to the natural gas processing plant; (14) warming the first bottoms stream in the heat exchanger and recycling the warmed first bottoms stream to the natural gas processing plant; (15) cooling the compressed recycle stream upstream of the heat exchanger in a cooler; (16) expanding a liquid stream from a bottom of the fractionation column in an expansion valve to reduce the temperature of the liquid stream to provide refrigerant to an internal knockback condenser in the fractionation column; (17) expanding the mixed first and second portions of the feed stream from step 9 in a first expansion valve upstream of feeding the fractionation column; (18) splitting the compressed recycle stream into a first portion and a second portion, wherein the second portion of the compressed recycle stream bypasses the heat exchanger, and mixing the second portion and the cooled first portion of the compressed recycle stream form the second recycle stream; and (19) compressing the first recycle stream, preferably to a pressure of 350 to 450 psig and preferably using an external compression stage, upstream of the compressor expander unit in step 5. There is only a single flash expansion step and/or only a single heat exchanger (excluding a condenser in the LNG fractionation tower) used in the cooling/warming steps in an LNG processing method according to the other preferred embodiments of the invention.

Most preferably, the flash expanding step comprises reducing the pressure of the cooled first overhead stream to 400 to 600 psig Most preferably, only a single flash stage/flash expansion step comprising an expansion valve upstream of feeding the cooled first overhead stream into a storage tank or flash stage vessel is need to produce a sufficient flash vapor refrigerant stream and a high purity LNG product stream. Most preferably, the feed stream in the preferred systems and methods is a sales gas stream from a natural gas processing plant comprising between 88-94% methane, although other sources of natural gas may also be used as the feed (preferably pre-processed to remove water vapor, excess amounts of carbon dioxide, and other contaminants using generally known to those of ordinary skill in the art that are not described herein). The systems and methods are preferably capable of producing at least 100,000 GPD LNG product having at least 95% methane. Preferably, the systems and methods produce a first overhead stream comprising 1 to 3% nitrogen and a flash vapor stream comprising 20 to 40% nitrogen The specific operating parameters for system 210 described herein as based on the specific computer modeling and feed stream parameters set forth above. These parameters and the various composition, pressure, and temperature values described above will vary depending on the feed stream parameters as will be understood by those of ordinary skill in the art. Any piece of equipment of process step described herein with any preferred embodiment may be combined with other pieces of equipment and process steps from other preferred embodiments even if not explicitly described with such other embodiment. Other alterations and modifications of the invention will likewise become apparent to those of ordinary skill in the art upon reading this specification in view of the accompanying drawings, and it is intended that the scope of the invention disclosed herein be limited only by the broadest interpretation of the appended claims to which the inventor is legally entitled.

I claim:

1. A system for producing an LNG product stream from a feed stream comprising nitrogen, methane, ethane, and other components, the system comprising:

a first fractionating column wherein the feed stream is separated into a first overhead stream and a first bottoms stream;

a heat exchanger for cooling at least a first portion of the feed stream upstream of the first fractionating column, for cooling the first overhead stream, and for cooling at least a first portion of a compressed recycle stream through heat exchange with the first bottoms stream and a primary refrigerant stream;

a flash stage comprising a vessel configured to receive the first overhead stream downstream of the heat exchanger, discharge a flash vapor stream, and discharge the LNG product stream; and a refrigeration loop comprising a first compressor expander unit, a second compressor expander unit, a first mixer, separator and a scrubber, wherein (1) the primary refrigerant stream is warmed in the heat exchanger to form a first recycle stream; (2) the first recycle stream is compressed in the first compressor expander unit and compressed in the second compressor expander unit to form the compressed recycle stream; (3) at least the first portion of the compressed recycle stream is cooled in the heat exchanger to form a second recycle stream; (4) the second recycle stream is expanded in the first compressor expander unit and expanded in the second compressor expander unit to form an expanded refrigerant stream; and (5) the expanded refrigerant stream is mixed with the flash vapor stream in the first mixer to form the primary refrigerant stream;

wherein the separator is configured to separate the second recycle stream into a second overhead stream and a second bottoms stream;

wherein the second overhead stream is expanded in the first compressor expander unit prior to feeding into the scrubber;

wherein the scrubber separates the expanded second overhead stream into a third overhead stream and a third bottoms stream;

wherein the third overhead stream is expanded in the second compressor expander unit to form the expanded refrigerant stream; and and wherein the feed stream comprises less than 95% methane and the LNG product stream comprises at least 95% methane.

2. The system of claim 1 wherein the feed stream is a sales gas stream from a natural gas processing plant comprising between 88-94% methane.

3. The system of claim 2 wherein a flow rate of the LNG product stream is at least 90% of a flow rate of the feed stream on a mass basis.

4. The system of claim 1 wherein the fractionating column comprises an internal condenser and does not have a reboiler.

5. The system of claim 4 further comprising a first splitter for splitting the feed stream into the first portion and a second portion, wherein the first portion is cooled in the heat exchanger and the second portion bypasses the heat exchanger; and a second mixer for mixing the first portion of the feed stream downstream of the heat exchanger with the second portion of the feed stream prior to feeding into the fractionating column.

6. The system of claim 5 further comprising a first expansion valve to expand the feed stream downstream of the second mixer and upstream of feeding the fractionation column.

7. The system of claim 6 further comprising a second expansion valve for expanding the first overhead stream downstream of the heat exchanger and upstream of the flash stage vessel.

8. The system of claim 1 further comprising a second mixer for mixing the first bottoms stream with the second and third bottoms streams prior to being warmed in the heat exchanger.

9. The system of claim 1 wherein the first overhead stream comprises 1 to 4% nitrogen.

10. The system of claim 1 wherein the flash vapor stream comprises 20 to 50% nitrogen.

11. The system of claim 1 further comprising one or more compressors to compress the first recycle stream to a pressure of 300 to 500 psig upstream of the first compressor expander unit in the refrigeration loop.

12. The system of claim 11 wherein the compressed recycle stream has a pressure of 700 to 900 psig.

13. The system of claim 1 wherein the refrigeration loop further comprises a cooler for cooling the compressed recycle stream upstream of the heat exchanger.

14. The system of claim 1 wherein the pressure in the flash stage vessel is 50 to 0 psig.

15. The system of claim 1 wherein the system comprises only a single flash stage.

16. The system of claim 15 wherein the system comprises only a single heat exchanger.

17. The system of claim 1 wherein the refrigerant loop further comprises a first splitter and a second mixer;

wherein the compressed recycle stream is split into the first portion of the compressed recycle stream and a second portion in the first splitter;

wherein the second portion of the compressed recycle stream bypasses the heat exchanger; and wherein the second portion and the cooled first portion are mixed in the second mixer to form the second recycle stream.

18. A system for producing an LNG product stream from a feed stream comprising nitrogen, methane, ethane, and other components, the system comprising:

a first fractionating column wherein the feed stream is separated into a first overhead stream and a first bottoms stream and wherein the fractionating column comprises an internal condenser and does not have a reboiler;

a heat exchanger for cooling at least a first portion of the feed stream upstream of the first fractionating column, for cooling the first overhead stream, and for cooling at least a first portion of a compressed recycle stream through heat exchange with the first bottoms stream and a primary refrigerant stream;

a flash stage comprising a vessel configured to receive the first overhead stream downstream of the heat exchanger, discharge a flash vapor stream, and discharge the LNG product stream;

a refrigeration loop comprising a first compressor expander unit, a second compressor expander unit, and a first mixer, wherein (1) the primary refrigerant stream is warmed in the heat exchanger to form a first recycle stream; (2) the first recycle stream is compressed in the first compressor expander unit and compressed in the second compressor expander unit to form the compressed recycle stream; (3) at least the first portion of the compressed recycle stream is cooled in the heat exchanger to form a second recycle stream; (4) the second recycle stream is expanded in the first compressor expander unit and expanded in the second compressor expander unit to form an expanded refrigerant stream; and (5) the expanded refrigerant stream is mixed with the flash vapor stream in the first mixer to form the primary refrigerant stream; and an expansion valve, wherein a liquid stream from a bottom of the fractionating column passes through the expansion valve to form a cooled liquid stream, wherein the cooled liquid stream passes through the condenser exiting as the first bottoms stream; and wherein the feed stream comprises less than 95% methane and the LNG product stream comprises at least 95% methane.

19. A method for producing an LNG product stream from a feed stream comprising nitrogen, methane, ethane, and other components, the method comprising:

separating the feed stream in a first fractionating column into a first overhead stream and a first bottoms stream;

cooling at least a first portion of the feed stream prior to the first fractionating column and cooling the first overhead stream through heat exchange with other process streams in a heat exchanger;

flash expanding the cooled first overhead stream to form a flash vapor stream and the LNG product stream;

warming a primary refrigerant stream in the heat exchanger to form a first recycle stream;

compressing the first recycle stream in a compressor expander unit to form a compressed recycle stream;

cooling at least a first portion of the compressed recycle stream to form a second recycle stream;

expanding the second recycle stream in the compressor expander unit to form an expanded refrigerant stream;

mixing the expanded refrigerant stream and the flash vapor stream to form the primary refrigerant stream; and wherein the feed stream comprises less than 95% methane and the LNG product stream comprises at least 95% methane.

20. The method of claim 19 wherein the feed stream is a sales gas stream from a natural gas processing plant comprising between 88-94% methane.

21. The method of claim 20 wherein a flow rate of the LNG product stream is at least 90% of the flow rate of the feed stream on a mass basis.

22. The method of claim 19 wherein the fractionating column comprises an internal condenser and does not have a reboiler.

23. The method of claim 19 further comprising splitting the feed stream into the first portion and a second portion, wherein the first portion is cooled in the heat exchanger and the second portion bypasses the heat exchanger; and mixing the first portion of the feed stream downstream of the heat exchanger with the second portion of the feed stream prior to feeding into the fractionating column.

24. The method of claim 20 wherein the expanding the second recycle stream step comprises expanding the second recycle stream in a first compressor expander unit and then in a second compressor expander unit to form the expanded refrigerant stream; and wherein the compressing the first recycle stream step comprises compressing the first recycle stream in the first compressor expander unit and then in the second compressor expander unit to form the compressed recycle stream.

25. The method of claim 24 further comprising compressing the first recycle stream to a pressure of 300 to 500 psig upstream of the first compressor expander unit.

26. The method of claim 23 further comprising expanding the mixed first and second portions of the feed stream in a first expansion valve upstream of feeding the fractionation column.

27. The method of claim 19 wherein there is only one flash expanding step.

28. The method of claim 27 wherein there is only one heat exchanger for all of the cooling and warming steps.

29. The method of claim 19 wherein the first overhead stream comprises 2 to 4% nitrogen.

30. The method of claim 29 wherein the compressed recycle stream has a pressure of 700 to 900 psig.

31. The method of claim 19 wherein the flash vapor stream comprises 20 to 50% nitrogen.

32. The method of claim 19 further comprising cooling the compressed recycle stream upstream of the heat exchanger in a cooler.

33. The method of claim 19 wherein the flash expanding step comprises reducing the pressure of the cooled first overhead stream to 0 to 25 psig.

34. The method of claim 19 further comprising:

splitting the compressed recycle stream into the first portion and a second portion, wherein the second portion of the compressed recycle stream bypasses the heat exchanger; and mixing the second portion and the cooled first portion of the compressed recycle stream form the second recycle stream.

35. A method for producing an LNG product stream from a feed stream comprising nitrogen, methane, ethane, and other components, the method comprising:

separating the feed stream in a first fractionating column into a first overhead stream and a first bottoms stream;

cooling at least a first portion of the feed stream prior to the first fractionating column and cooling the first overhead stream through heat exchange with other process streams in a heat exchanger;

flash expanding the cooled first overhead stream to form a flash vapor stream and the LNG product stream;

warming a primary refrigerant stream in the heat exchanger to form a first recycle stream;

compressing the first recycle stream comprises compressing the first recycle stream in a first compressor expander unit and then in a second compressor expander unit to form a compressed recycle stream;

cooling at least a first portion of the compressed recycle stream to form a second recycle stream;

expanding the second recycle stream in the first compressor expander unit and then in the second compressor expander unit to form an expanded refrigerant stream;

mixing the expanded refrigerant stream and the flash vapor stream to form the primary refrigerant stream;

separating the second recycle stream into a second overhead stream and a second bottoms stream in a separator, wherein the second overhead stream is expanded in the first compressor expander unit prior to feeding into a scrubber;

separating the expanded second overhead stream into a third overhead stream and a third bottoms stream in the scrubber, wherein the third overhead stream is expanded in the second compressor expander unit to form the expanded refrigerant stream; and wherein the feed stream is a sales gas stream from a natural gas processing plant comprising between 88-94% methane and the LNG product stream comprises at least 95% methane.

36. The method of claim 35 further comprising mixing the first bottoms stream with the second and third bottoms streams to form a mixed bottoms stream and warming the mixed bottoms stream in the heat exchanger.

37. The method of claim 36 further comprising recycling the warmed mixed bottoms stream to the natural gas processing plant.

38. A method for producing an LNG product stream from a feed stream comprising nitrogen, methane, ethane, and other components, the method comprising:

separating the feed stream in a first fractionating column into a first overhead stream and a first bottoms stream;

cooling at least a first portion of the feed stream prior to the first fractionating column and cooling the first overhead stream through heat exchange with other process streams in a heat exchanger;

flash expanding the cooled first overhead stream to form a flash vapor stream and the LNG product stream;

warming a primary refrigerant stream in the heat exchanger to form a first recycle stream;

compressing the first recycle stream in a compressor expander unit to form a compressed recycle stream;

cooling at least a first portion of the compressed recycle stream to form a second recycle stream;

expanding the second recycle stream in the compressor expander unit to form an expanded refrigerant stream;

mixing the expanded refrigerant stream and the flash vapor stream to form the primary refrigerant stream;

warming the first bottoms stream in the heat exchanger;

recycling the warmed first bottoms stream to the natural gas processing plant; and wherein the feed stream is a sales gas stream from a natural gas processing plant comprising between 88-94% methane and the LNG product stream comprises at least 95% methane.

39. The method of claim 38 wherein there is only one heat exchanger for all of the cooling and warming steps.

40. A method for producing an LNG product stream from a feed stream comprising nitrogen, methane, ethane, and other components, the method comprising:

separating the feed stream in a first fractionating column into a first overhead stream and a first bottoms stream, wherein the fractionating column comprises an internal condenser and does not have a reboiler;

cooling at least a first portion of the feed stream prior to the first fractionating column and cooling the first overhead stream through heat exchange with other process streams in a heat exchanger;

flash expanding the cooled first overhead stream to form a flash vapor stream and the LNG product stream;

warming a primary refrigerant stream in the heat exchanger to form a first recycle stream;

compressing the first recycle stream in a compressor expander unit to form a compressed recycle stream;

cooling at least a first portion of the compressed recycle stream to form a second recycle stream;

expanding the second recycle stream in the compressor expander unit to form an expanded refrigerant stream;

mixing the expanded refrigerant stream and the flash vapor stream to form the primary refrigerant stream;

expanding a liquid stream from a bottom of the fractionating column in an expansion valve to reduce the temperature of the liquid stream prior to entering the condenser, wherein the liquid stream provides refrigerant to the condenser; and wherein the feed stream comprises less than 95% methane and the LNG product stream comprises at least 95% methane.

* * * * *